US007743539B1

(12) United States Patent
Kennedy

(10) Patent No.: US 7,743,539 B1
(45) Date of Patent: Jun. 29, 2010

(54) DISPLAY SIGN APPARATUS

(76) Inventor: Britt Kennedy, 100 E. Chestnut, Amite, LA (US) 70422

( * ) Notice: Subject to any disclaimer, the term of this patent is extended or adjusted under 35 U.S.C. 154(b) by 0 days.

(21) Appl. No.: 12/331,776

(22) Filed: Dec. 10, 2008

Related U.S. Application Data

(60) Provisional application No. 61/012,663, filed on Dec. 10, 2007.

(51) Int. Cl.
*G09F 15/00* (2006.01)

(52) U.S. Cl. ..... 40/607.03; 40/607.01; 40/607.05; 40/607.09; 40/610

(58) Field of Classification Search ..... 40/605, 40/607.1, 607.09, 607.01, 607.11, 607.03, 40/610; 248/201, 318, 251, 255, 258
See application file for complete search history.

(56) References Cited

U.S. PATENT DOCUMENTS

| | | | | |
|---|---|---|---|---|
| 1,504,218 | A * | 8/1924 | Crowell | 156/207 |
| 2,008,974 | A * | 7/1935 | Weber | 156/207 |
| 3,181,261 | A * | 5/1965 | Swartz | 40/613 |
| 4,259,803 | A | 4/1981 | Sittler | |
| 4,657,611 | A * | 4/1987 | Guins | 156/157 |
| 4,660,310 | A | 4/1987 | Farmer | |
| 4,894,937 | A | 1/1990 | Davis | |
| 5,042,183 | A | 8/1991 | Kennedy | |
| 5,207,402 | A | 5/1993 | Berry-Tremmel et al. | |
| 5,307,580 | A | 5/1994 | Farmer | |
| 5,595,010 | A | 1/1997 | Fuller et al. | |
| 5,878,517 | A | 3/1999 | Gill | |
| 6,170,183 | B1 * | 1/2001 | Keefe | 40/607.03 |
| 6,547,204 | B1 | 4/2003 | Peck | |
| 7,437,844 | B1 | 10/2008 | Kennedy | |
| 2005/0077441 | A1 | 4/2005 | Coverstone et al. | |

FOREIGN PATENT DOCUMENTS

FR 2874279 A1 * 2/2006

* cited by examiner

*Primary Examiner*—Cassandra Davis
(74) *Attorney, Agent, or Firm*—Garvey, Smith, Nehrbass & North, L.L.C.; Charles C. Garvey, Jr.

(57) ABSTRACT

A display sign apparatus includes a sign panel having opposed surfaces, each of the surfaces providing a locale for displaying a selected message to viewers. The panel preferably is in the form of a first and second panel section that are connected together such as adhered with an adhesive such as glue. Each of the first and second panel sections provides grooves that are receptive of rods. A support structure enables the panel to be supported in an upright position. The support structure can include as an example a horizontal member and a vertical member. The support structure can for example be an inverted L shaped post having a vertical section that is embedded in the earth and a horizontal section that extends laterally and generally horizontally from the vertical section. One or more rods extends through grooves of the panels to support the sign panel in an upright, vertical position. At least one of the rods extends vertically through the panel section that provides horizontal grooves. At least one of the rods extends vertically through the panel section that provides vertical grooves. These rods are then attached to the support structure for supporting and rigidifying the sign with respect to the support structure.

19 Claims, 5 Drawing Sheets

DISPLAY SIGN APPARATUS

CROSS-REFERENCE TO RELATED APPLICATIONS

Priority of U.S. Provisional Patent Application Ser. No. 61/012,663, filed Dec. 10, 2007, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to outdoor display signs of the type that are easily movable and that can be used to display a different item for sale or other information that changes from time to time. More particularly, the present invention relates to an improved display sign apparatus that employs a display panel having first and second pluralities of grooves, slots, or passageways that extend in opposing directions (e.g. perpendicular to each other) and wherein in a second embodiment, multiple sections of a sign apparatus are stackable, one upon the other.

2. General Background of the Invention

Real estate companies and candidates for election to public office are examples of a user of outdoor display signs. Real estate agents must place their display signs in different locations and at different times, such as before and after a home has sold. Additionally, display signs must often carry a display panel that provides varying information such as for example the name of a real estate agent that is selling a particular piece of property, or a telephone number such as office and/or mobile telephone number. Other information must be displayed that can vary with time or from one location to another.

BRIEF SUMMARY OF THE INVENTION

The present invention provides a display sign that employs a panel having opposed surfaces. Each of the surfaces provides a locale for a selected message to be displayed to viewers. The panel includes first and second pluralities of grooves or channels or passageways, the first plurality being generally perpendicular to the second plurality.

A support structure enables the panel to be supported in an upright position. The support structure can include one or more horizontal members that connect to the panel by occupying all or part of a groove or channel or passageway of the first plurality and one or more vertical members that connect to the panel by occupying all or part of a groove or channel or passageway of a second plurality.

A support structure in the form of a post or posts can provide a vertical and a horizontal section. The horizontal members are anchored to the post vertical section and the vertical members are anchored to the post horizontal section.

In another embodiment, a display sign provides a base section having spaced apart upright members connected by a transverse or horizontal member. A pair of lower sleeves are connected to the base section at a position next to the lower end portion of the base section, each sleeve having a bore that is receptive of an anchoring peg.

A plurality of pegs are provided, each peg being removably fitted into the bore of a sleeve for enabling the pegs to secure the base section to the other surface.

A pair of upper sleeves are attached to the base section at a position that is spaced vertically above the lower sleeves.

Center and upper sections stack vertically upon the base section to provide assembled sections that include a center section connected to the base section at the upper sleeves and an upper section connected to the center section at a position above the center section. A sign panel is supported by the assembled sections, providing a surface (or surfaces) for displaying a message to a viewer.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 6:
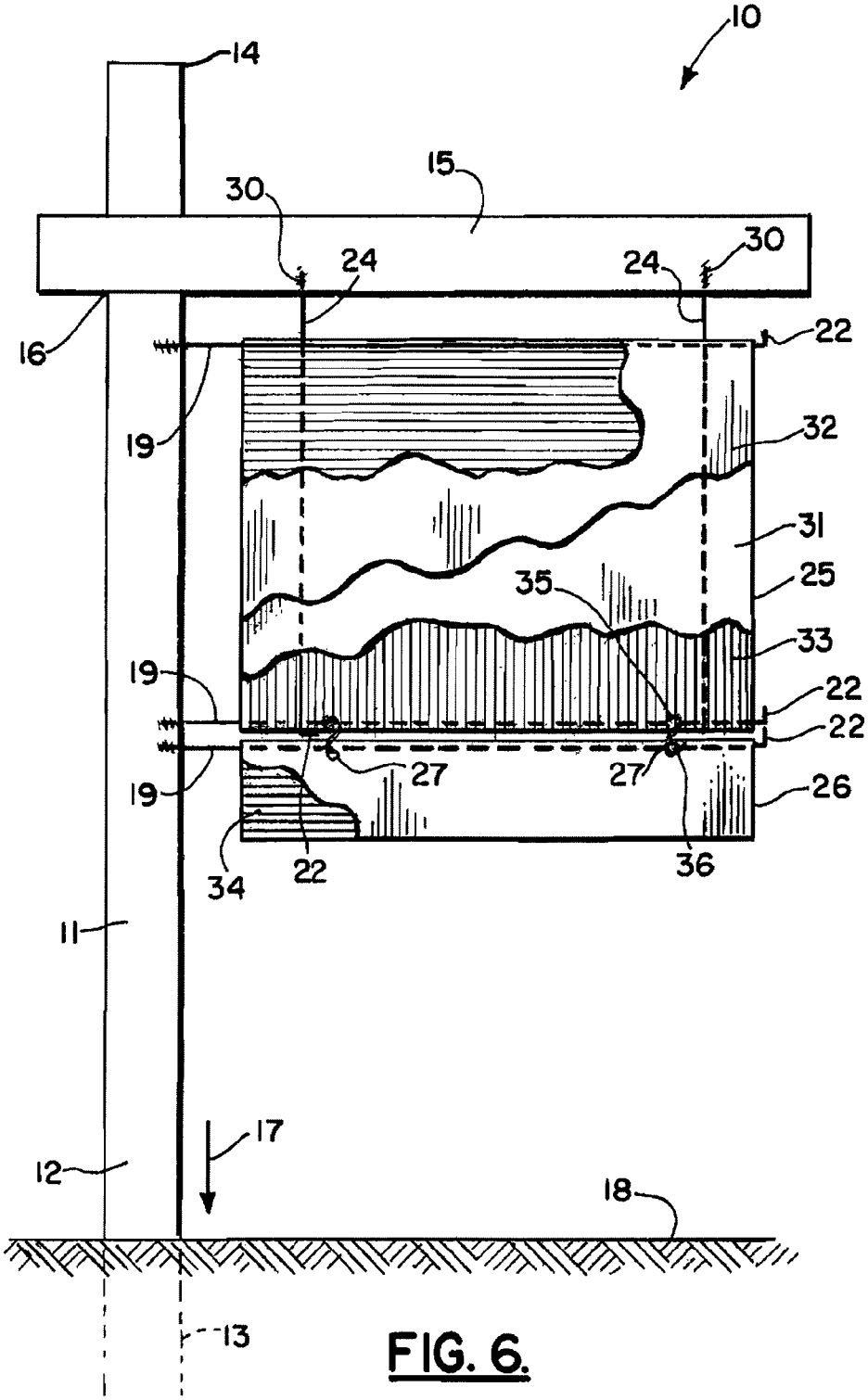
FIG. 6 is a front view of the preferred embodiment of the apparatus of the present invention.

The preferred embodiment of the apparatus of the present invention is designated generally by the numeral 10 in FIG. 6. Display sign apparatus 10 provides a support 11 that can include a first section 12 and a second section 15. In the embodiment shown, the support 11 can provide a first section 12 in the form of a generally vertically extended post having a lower end portion 13 and an upper end portion 14. The support 11 can include a second section 15 that is attached to and supported by the first section 12 by providing a joint 16 that connects the sections 12, 15 together.

Figure 1:
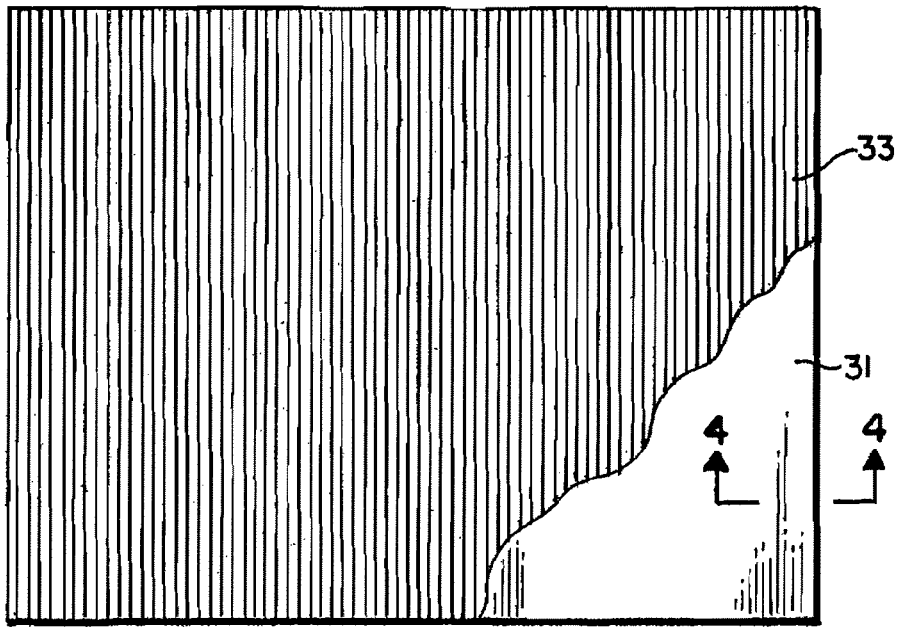
FIG. 1 is a partial elevation view of the preferred embodiment of the apparatus of the present invention.
Figure 2:
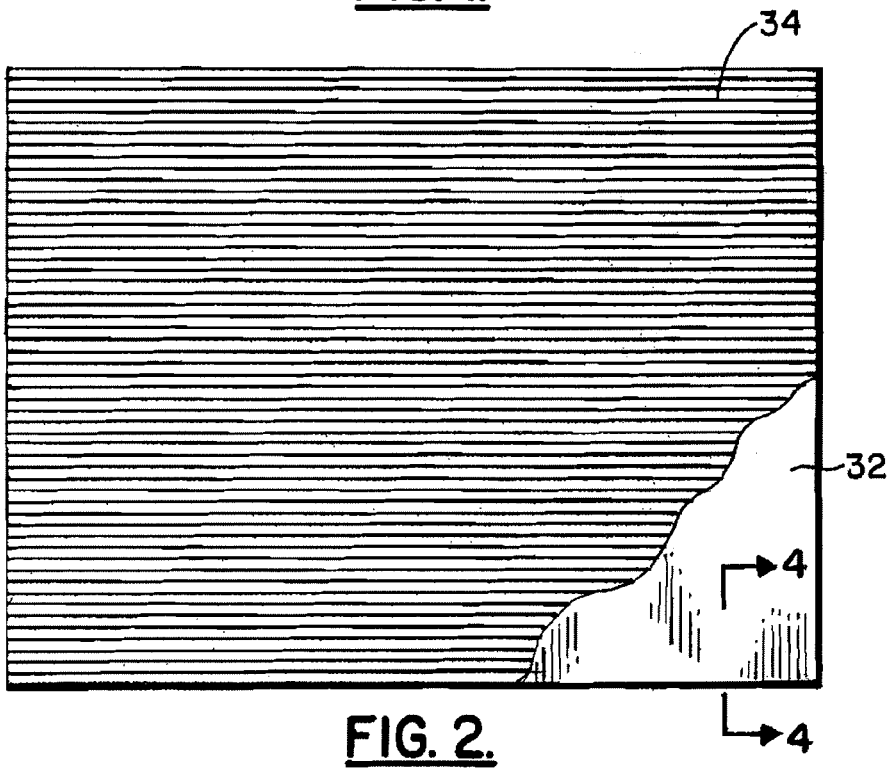
FIG. 2 is a partial elevation view of the preferred embodiment of the apparatus of the present invention.

As shown in FIG. 6, arrow 17 indicates schematically that support 11 can be embedded in the earth's surface 18 or otherwise anchored so that the support 11 is supported in a generally upstanding position as shown in FIG. 1. Lower end portion 13 of first section 12 can be embedded in concrete a distance of for example between about 12 inches to 24 inches. Alternatively, the support 11 could be embedded in a hole that is packed with earth so that support 11 can be more easily removed for placement at a different location.

Display panel 25 is provided for displaying selected written or graphic or pictorial information to a viewer. The panel 25 can for example be used to display the "for sale" information that is associated with the sale of a home. Such information can include the name of the real estate agency or company that is selling the house on behalf of the owner. Such information can include a telephone number or numbers, an address or addresses, the name of a real estate agent or other information. An additional panel 26 can be suspended from panel 25 using for example hangers such as S hooks 27.

Panel 25 is supported upon support 11 with rods 19, 24. In FIG. 1, a plurality of rods 19, 24 are provided including generally horizontally extending rods 19 and generally vertically extending rods 24.

Each rod 19, 24 provides opposed end portions. The rod 19 has rod ends 20, 21. The rod end 20 is provided with external threads 23 that enable it to be embedded in support 11 first section 12 if the support is of wooden or like material that will accept the external threads or externally threaded end portion of rod 19.

Rod 19 provides a handle 22 or other enlarged portion or tool portion or grip that enables the rod 19 to be rotated such as when the external threads 23 are to be embedded in support 11. Handle 22 (or enlarged portion or grip or other) can be eliminated if the rod 19 or 24 is to be embedded by connecting end 21 to the chuck of an electric or like rotary drill.

It should be understood that rod 24 can be similarly constructed to rod 19 to provide end portions 28, 29, the end portion 28 being provided with an externally threaded portion or external threads 30. The rod or rods 24 can be embedded in support 11, embedded in a second section 15 as shown in FIG. 6. Each rod 24 can be provided with a handle 22 at end 29.

In FIGS. 2-5, panel 25 is shown as comprised of a pair of corrugated plastic panels 31, 32. It is preferred that each of the panels 31, 32 provides a plurality of grooves or passageways or channels that are receptive of a rod 19 or 24.

The panel section 31 provides a plurality of spaced apart grooves 33. The panel section 32 provides a plurality of spaced apart grooves 34. The grooves or passageways or channels 33, 34 can be part of the corrugations of a corrugated sign, such as corrugated plastic panels or panel sections that are commercially available. The panel sections 31, 32 can be affixed together face to face using an adhesive or other connective material so that the grooves 33 of the panel 31 are generally perpendicular to the grooves 34 of the panel 32 (see FIGS. 3 and 5). In this fashion, the generally horizontally extending rod or rods 19 extend through grooves 34 of panel section 32.

The rods 24, which are generally vertically oriented in FIG. 6, would extend through grooves or passageways or channels 33 of panel section 31 which are generally vertically extending grooves. In FIGS. 1-3 and 5-6, the panel 25 is thus constructed of a pair of panel sections 31, 32 that are affixed together (e.g. glued). The panel 25 is anchored to support 11 using a plurality of rods 19 and/or 24.

In the example of FIG. 6, two generally horizontally extending rods 19 are provided that extend through the horizontally positioned grooves 34 of panel section 32. These same generally horizontally extending rods 19 are embedded in support 11 by embedding the externally threaded portion or external threads 23 of rod 19 in support 11 and more particularly in the first section 12 of support 11. Similarly, the rods 24 are vertically positioned rods that extend through the vertical grooves or passageways or channels 33 of panel section 31.

These same vertically positioned rods 24 are embedded in support 11 and preferably in the second section 15 of support 11. As with the rods 19, the rods 24 provide external threads 30 that are embedded in support 11 and more particularly that are embedded in second section 15 of support 11. As with the rod 19, the rod 24 can provide an end portion having a handle 22, enlarged section or tool section which enables a user to grip and rotate the rod 24 when embedding the external threads 30 of the rod 24 in support 11. This enlarged part or handle 22 can be eliminated if the rods 24 are to be embedded by using an electric or manual drill with a chuck, the chuck being connectable to end portion 29 of each rod 24 when rotating and embedding it in support 11.

Figure 3:
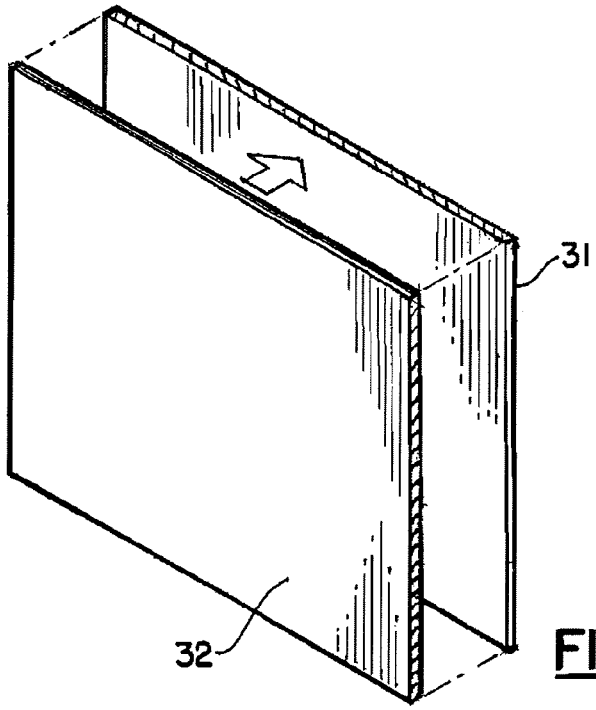
FIG. 3 is a partial perspective view of the preferred embodiment of the apparatus of the present invention illustrating the display panel.
Figure 4:
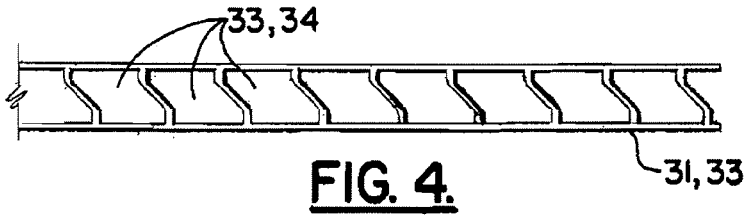
FIG. 4 is a sectional view taken along lines 4-4 of FIGS. 1 and 2.
Figure 5:
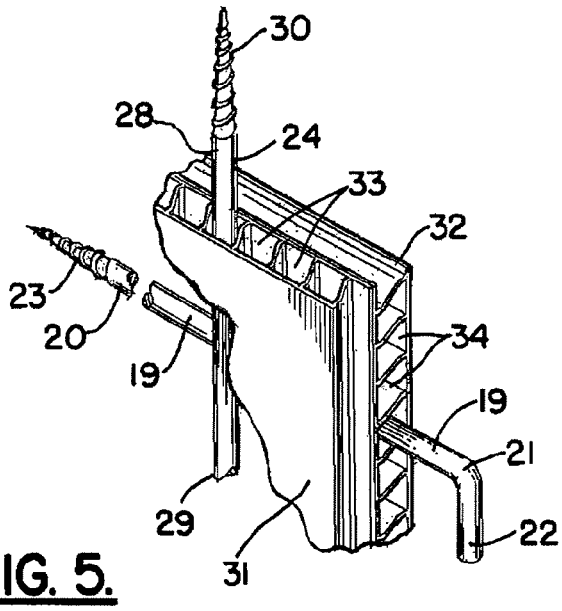
FIG. 5 is a partial perspective view of the preferred embodiment of the apparatus of the present invention.

In FIG. 6, an additional sign panel 26 can be fitted with a rod 19. Rod 19 extends through horizontal grooves of the sign panel 25 in the same manner that they extend through the horizontal grooves 34 of the section 32. In this fashion, the panel 25 can be anchored to the support 11 using a rod 19. The panel 25 can also be attached to and supported by the combination of rod 19 that is attached to the panel 25 and/or a part of the panel 25 using S hooks or like hangers 27. In such a case, the hangers 27 can be fitted through holes that are formed in panel 25 just above the lower of the two rods 19 as shown in FIG. 1. In FIG. 3, the panels 25, 26 are each fitted with hangers 27.

The panels 25 can thus be hung with hangers 27 from either support 11 or from a horizontally extending rod 19. The panel 26 can be simply suspended from the panel 25 using hangers 27 such as in the form of S hooks that attach to openings 35 at the lower end of panel 25 and openings 36 that are in the top of panel 26. As an example, the panel could be used to display basic information about a company in a message such as a for sale sign of a real estate company. The panel 26 could include information that is changed often, such as for example the name and/or telephone number of the real estate agent that was particularly interested in selling a particular piece of property. The panel 26 could also be used to change information that is information accompanying the information on panel 25 such as for example, an open house being offered at certain hours.

Figure 7:
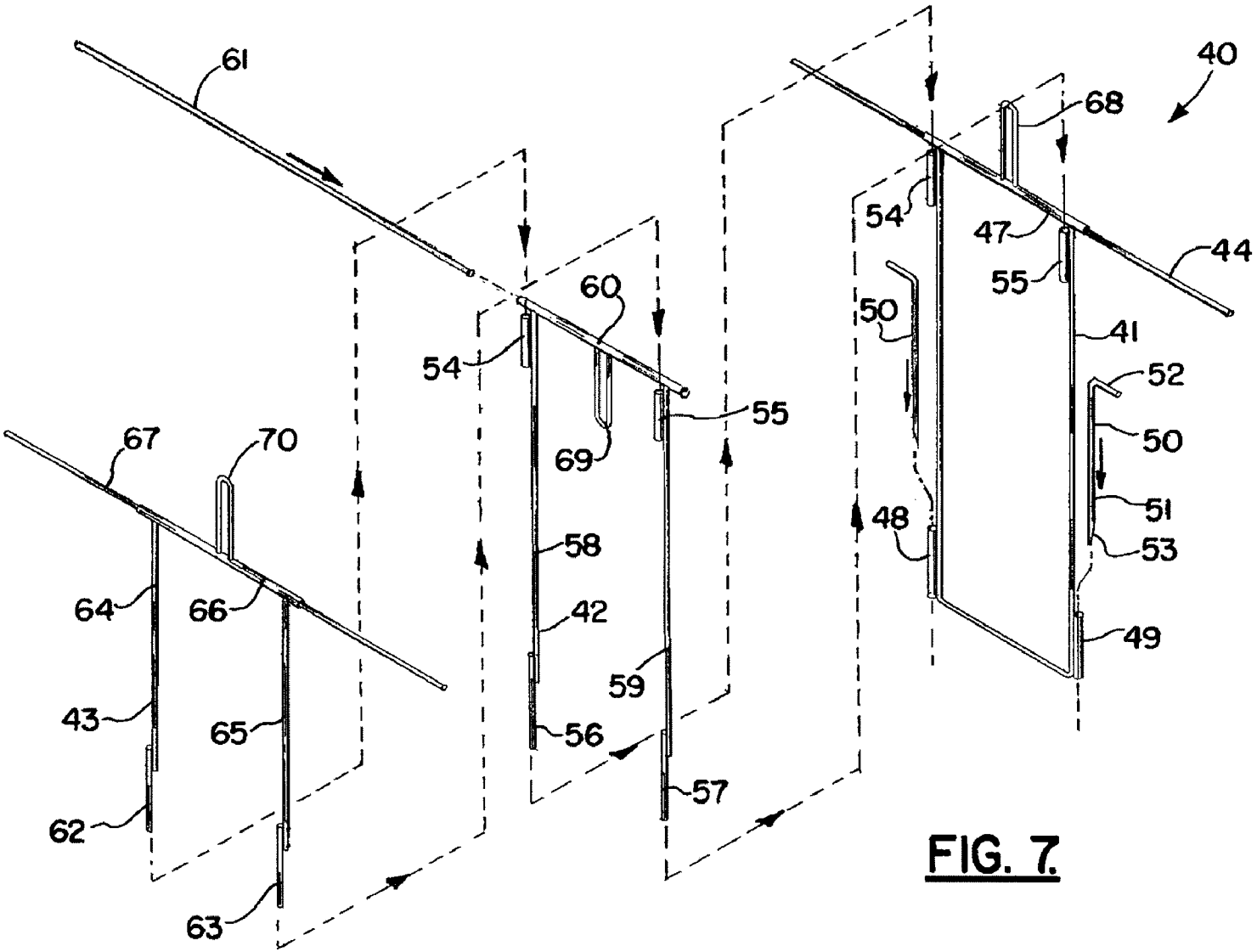
FIG. 7 is a perspective exploded view of a second embodiment of the apparatus of the present invention illustrating the anchoring spikes or pegs prior to being attached to the base section.
Figure 8:
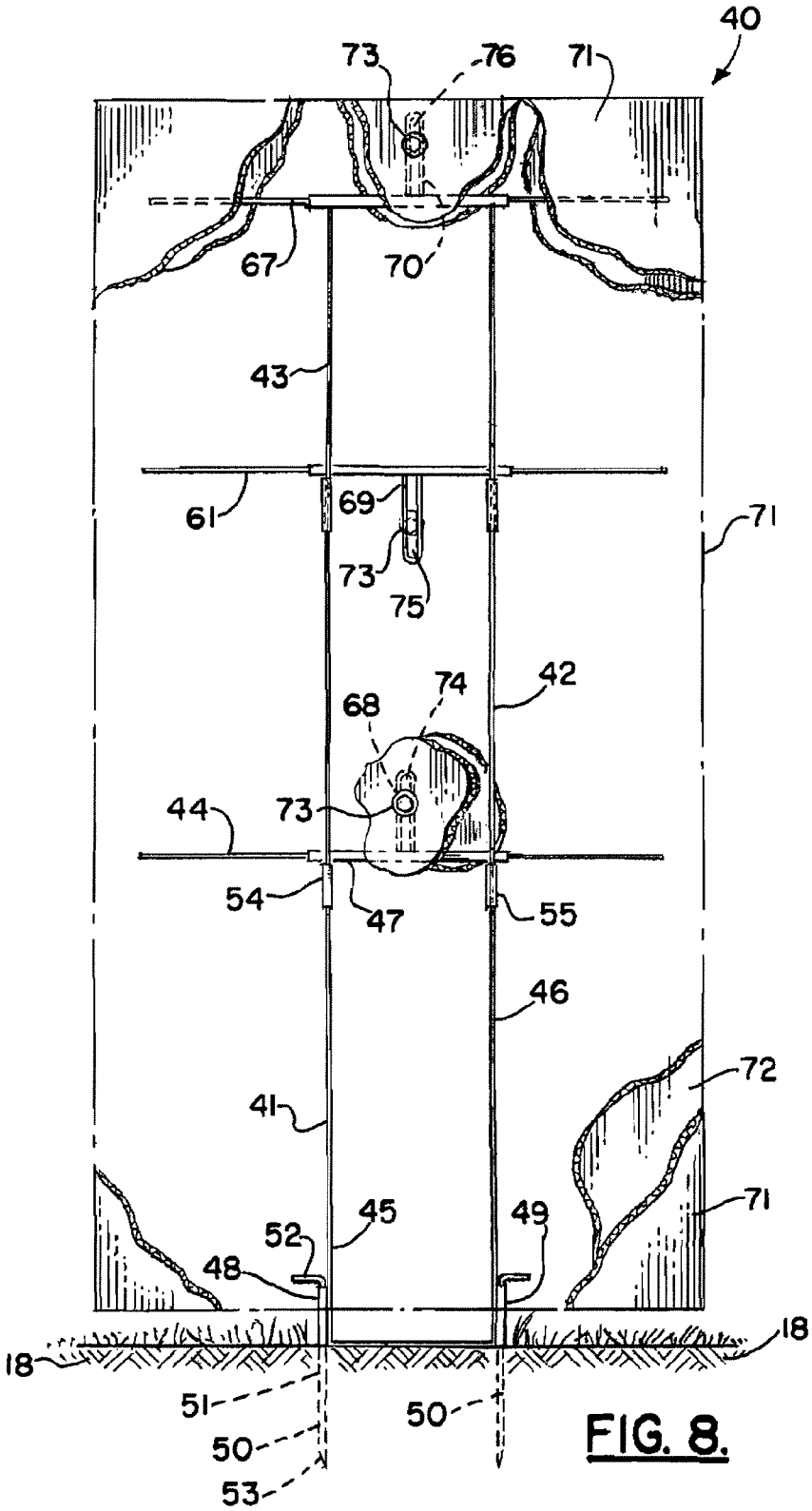
FIG. 8 is an elevation view of the second embodiment of the apparatus of the present invention.

FIGS. 7-8 show a second embodiment of the apparatus of the present invention designated generally by the numeral 40. Display sign 40 includes a number of sections that are stacked vertically. The display sign 40 can include a base section 41, one or more central sections 42 and an upper section 43. Each of the sections 41, 42, 43 can employ optionally a generally horizontally extending rod 44, 61, 67 that extend side to side to a position at or near the edges of sign display panel 71 or panels 71, 72.

Base section 41 includes a pair of vertical members 45, 46 connected with horizontal section 47 which is preferably a hollow tube or tubular member. Each of the vertical sections 45, 46 provides a sleeve 48, 49. The sleeve 48 is attached (for example, welded) to the vertical section 45. The sleeve 49 is attached (for example, welded) to the vertical section 46.

Spikes 50 are provided for anchoring base section 41 into an underlying soil mass, or earth's surface 18. Each of the spikes 50 can include a vertical section 51, an upper step 52, and a lower point or tapered end 53. In order to install base section 41, a user places each spike 50 through a sleeve 48 or 49 and then drives the spike 50 into the earth's surface 18 preferably in a generally vertical position.

Sleeves 54, 55 are provided at the upper end portion of base section 41, next to horizontal section 47 and on the upper end portion of middle section 42. Each sleeve 54, 55 on lower section 41 is receptive of a lower peg 56, 57 of central section 42. Each peg 62, 63 of upper section 43 fits a sleeve 54 or 55 of middle section 42 as shown in FIGS. 7-8. Central section 42 provides a pair of pegs 56, 57 to which are attached a pair of vertical sections or vertical rods 58, 59. A sleeve 54 or 55 is attached to the top of each vertical section 58, 59. A transverse rod 60 is attached to the upper end portion of each of the vertical rods 58, 59 using welding, for example. The rod can be in the form of a hollow tube that extends horizontally and that is receptive of a rod 61.

The upper section 43 can be of the same construction as the central section 42 as shown in FIGS. 7-8. The upper section 43 can thus include a pair of pegs 62, 63 to which are attached a pair of vertical rods 64, 65 and a transverse or generally horizontal rod 66 that can be in the form of a sleeve having a bore that is receptive of a rod 67.

Each of the sleeves 47, 60, 66 can have attached thereto a hanger 68, 69, 70. Each of the hangers 68, 69, 70 can be simply a tab or flange that is connected (for example, welded) to a horizontal sleeve 47, 60, 66. The hangers 68, 69, 70 each provide an opening 74, 75, 76 receptive of a threaded fastener such as a bolted connection 73 which helps secure panels 71, 72 to the combination of the sections 41, 42, 43 and the rods 44, 61, 67. A washer or washers can be placed on each panel 71, 72 as part of each bolted connection 73.

If the base section is for example, about 38 inches tall, it could be combined with a central section that is about 30 inches tall and an upper section that is about 22 inches tall for a total height of about 90 inches. The display sign 40 of the present invention is thus particularly attractive to candidates running for political office or stores having a sale. The signage can be thus directed to persons riding in a motor vehicle and wherein their attention to the sign may only last a couple of seconds.

The following is a list of parts and materials suitable for use in the present invention.

PARTS LIST

PARTS LIST

| Part Number | Description |
|---|---|
| 10 | display sign |
| 11 | support |
| 12 | first section |
| 13 | lower end portion |
| 14 | upper end portion |
| 15 | second section |
| 16 | joint |
| 17 | arrow |
| 18 | earth's surface |
| 19 | rod |
| 20 | end portion |
| 21 | end portion |
| 22 | handle |
| 23 | external threads |
| 24 | rod |
| 25 | panel |
| 26 | panel |
| 27 | hangers |
| 28 | end portion |
| 29 | end portion |
| 30 | external threads |
| 31 | panel section |
| 32 | panel section |
| 33 | grooves |
| 34 | grooves |
| 35 | opening |
| 36 | opening |
| 40 | display sign |
| 41 | base section |
| 42 | central section |
| 43 | upper section |
| 44 | rod |
| 45 | vertical section |
| 46 | vertical section |
| 47 | horizontal member/tube |

-continued

PARTS LIST

| Part Number | Description |
|---|---|
| 48 | sleeve |
| 49 | sleeve |
| 50 | spike |
| 51 | vertical section |
| 52 | step |
| 53 | pointed end |
| 54 | sleeve |
| 55 | sleeve |
| 56 | peg |
| 57 | peg |
| 58 | vertical section |
| 59 | vertical section |
| 60 | horizontal member/tube |
| 61 | rod |
| 62 | peg |
| 63 | peg |
| 64 | rod |
| 65 | rod |
| 66 | horizontal member/tube |
| 67 | rod |
| 68 | hanger |
| 69 | hanger |
| 70 | hanger |
| 71 | panel |
| 72 | panel |
| 73 | bolted connection |
| 74 | opening |
| 75 | opening |
| 76 | opening |

All measurements disclosed herein are at standard temperature and pressure, at sea level on Earth, unless indicated otherwise. All materials used or intended to be used in a human being are biocompatible, unless indicated otherwise.

The foregoing embodiments are presented by way of example only; the scope of the present invention is to be limited only by the following claims.

The invention claimed is:

1. A display sign, comprising:

a) a sign panel that has opposed surfaces, each surface providing a locale for displaying a selected message to viewers, said panel having first and second pluralities of grooves and ridges, the first plurality of grooves and ridges being perpendicular to the second plurality of grooves and ridges;

b) a support structure that enables the panel to be supported in an upright position;

c) the support structure including one or more horizontal members that connect to the panel by occupying all or part of a groove of the first plurality of grooves and one or more vertical members that connect to the panel by occupying all or part of a groove of the second plurality of grooves, there being at least three of said vertical and horizontal members; and d) a post that is part of the support structure, said post having a vertical and a horizontal section, the horizontal members being anchored in the post vertical section, the vertical members being anchored to the post horizontal section.

2. The display sign of claim 1 further comprising a second panel, one of said panel being suspended from the other of said panel.

3. The display sign of claim 1 wherein the panel is comprised of a first corrugated sheet adhered to a second corrugated sheet.

4. The display sign of claim 1 wherein the panel is comprised of a first corrugated sheet connected to a second corrugated sheet.

5. The display sign of claim 1 wherein the panel is comprised of a first corrugated sheet positioned upon a second corrugated sheet.

6. The display sign of claim 1 wherein the panel is of a plastic material.

7. The display sign of claim 1 wherein each vertical member is a rod.

8. The display sign of claim 1 wherein each horizontal member is a rod.

9. The display sign of claim 8 wherein at least one rod extends completely through the panel.

10. The display sign of claim 1 wherein the panel has upper and lower edges, and wherein one of the horizontal members is connected to the panel at a position that is next to the lower edge.

11. The display sign of claim 1 wherein the panel has upper and lower edges, and wherein one of the horizontal members is connected to the panel at a position that is next to the upper edge.

12. A display sign, comprising:

a) a sign panel that has opposed surfaces, each surface providing a locale for displaying a selected message to viewers, said panel having first and second pluralities of grooves and ridges, the first plurality of grooves and ridges being perpendicular to the second plurality of grooves and ridges;

b) a support structure that enables the panel to be supported in an upright position;

c) the support structure including one or more horizontal members that connect to the panel by occupying all or part of a groove of the first plurality of grooves and one or more vertical members that connect to the panel by occupying all or part of a groove of the second plurality of grooves;

d) a post that is part of the support structure, said post having a vertical and a horizontal section, the horizontal members being anchored in the post vertical section, the vertical members being anchored to the post horizontal section; and e) wherein there are at least two of said vertical members.

13. A display sign, comprising:

a) a sign panel that has opposed surfaces, each surface providing a locale for displaying a selected message to viewers, said panel having first and second pluralities of grooves and ridges, the first plurality of grooves and ridges being perpendicular to the second plurality of grooves and ridges;

b) a support structure that enables the panel to be supported in an upright position;

c) the support structure including one or more horizontal members that connect to the panel by occupying all or part of a groove of the first plurality of grooves and one or more vertical members that connect to the panel by occupying all or part of a groove of the second plurality of grooves;

d) a post that is part of the support structure, said post having a vertical and a horizontal section, the horizontal members being anchored in the post vertical section, the vertical members being anchored to the post horizontal section; and e) wherein there are at least two of said horizontal members.

14. A display sign, comprising:

a) a sign panel that has opposed surfaces, each surface providing a locale for displaying a selected message to viewers, said panel having first and second pluralities of grooves and ridges, the first plurality being perpendicular to the second plurality;

b) a support structure that enables the panel to be supported in an upright position;

c) the support structure including one or more horizontal members that connect to the panel by occupying all or part of a groove of the first plurality and one or more vertical members that connect to the panel by occupying all or part of a groove of the second plurality;

d) a post that is part of the support structure, said post having a vertical and a horizontal section, the horizontal members being anchored in the post vertical section, the vertical members being anchored to the post horizontal section; and e) wherein at least one rod has an enlarged portion that enables the rod to be rotated.

15. The display sign of claim 14 wherein the rod is externally threaded opposite the enlarged portion.

16. A display stand, comprising:

a) a support frame configured to be supported by an underlying support surface, the frame having upper and lower end portions and including vertical and horizontal sections;

b) a display panel that is attached to the frame upper end portion, the display panel having first and second sets of parallel grooves, the grooves of one set being generally perpendicular to the grooves of the other set; and c) the frame including one or more rods that engage one or more grooves of the first set and one or more grooves of the second set, a pair of said rods being generally parallel.

17. The display stand of claim 16 wherein the frame includes at least a pair of rods that connect to a pair of grooves of the first set.

18. The display stand of claim 16 wherein the frame includes at least a pair of rods that connect to a pair of grooves of the second set.

19. The display stand of claim 16 wherein the panel is comprised of first and second corrugated sheets, one sheet having the first set of grooves, the other sheet having the second set of grooves.

* * * * *